United States Patent [19]

Goff

[11] 4,003,185

[45] Jan. 18, 1977

[54] CASER APPARATUS

[76] Inventor: Otis Ward Goff, 7151 Carlsbrook, Portage, Mich. 49081

[22] Filed: June 6, 1975

[21] Appl. No.: 584,266

[52] U.S. Cl. ..... 53/61; 53/166; 53/248

[51] Int. Cl.[2] ..... B65B 57/14; B65B 39/02

[58] Field of Search ..... 53/61, 166, 248

[56] References Cited

UNITED STATES PATENTS

| | | | |
|---|---|---|---|
| 2,219,827 | 10/1940 | Kimball et al. | 53/248 X |
| 2,556,082 | 6/1951 | Hartness | 53/166 X |
| 2,650,746 | 9/1953 | Rideout et al. | 53/61 X |
| 3,634,996 | 1/1972 | Reichert et al. | 53/248 X |

*Primary Examiner*—Travis S. McGehee
*Attorney, Agent, or Firm*—Gordon W. Hueschen

[57] ABSTRACT

An apparatus for assembling a charge of articles such as bottles and loading the articles into a container, comprising a supporting grid structure, conveyor means for loading a plurality of the articles onto the grid structure, means for moving the grid structure to permit the articles to drop between the members of the grid system through the open spaces therebetween, and means for retarding the rate of fall of the articles into the container comprising a plurality of retarder means each comprising a lever arm having an article-engaging plate at one end and an adjustably mounted weight at the other end for applying the proper amount of retarding force against the articles as they fall into the container. The entire operation may be carried out automatically by means of an electrically-controlled and operated apparatus.

14 Claims, 11 Drawing Figures

21
21
23
8
28
27
15
44
45
29
46
54
47
52
55
53
50
48
51
67
49
60
56
57
66
58
59
8.
61
62
63

23
21
21
15
28
27
44
45
29
50
46
47
51
60
48
53
66
52
54
55
49
56
57
58
59
67

CASER APPARATUS

BACKGROUND OF THE INVENTION

1. Field of Invention

The present invention relates to apparatus for packing articles in cases for shipment or storage, and more particularly refers to a packing machine for automatically assembling bottles or the like into proper grouping, and loading the articles into a container without damaging the articles.

2. Prior Art

Apparatus for assembling and loading articles such as bottles, cans, or the like, into containers for shipment are known in the art. Such apparatus generally comprises a conveyor for transporting the articles onto a platform, and means for loading a plurality of bottles in the desired formation onto a platform such as a grid. The platform or grid is then appropriately moved to permit the articles to drop through spaces intermediate the grid members and to fall into the container. Means has been disclosed for retarding the fall of the articles to prevent breakage, generally in the form of flexible or elastomeric fingers. However, the apparatus of the prior art has not been entirely satisfactory. The retarding force is difficult to control and generally different size retarding means must be applied to different size articles. Moreover, when the type of article or its size or configuration is changed, it is difficult to obtain proper retarding action.

SUMMARY OF THE INVENTION

It is accordingly an object of the present invention to provide an improved apparatus for loading articles into a container.

It is an additional object to provide an apparatus for loading articles into a carton utilizing a movable grid.

It is a still additional object of the invention to provide an effective means for retarding the rate of fall of the articles into the container.

It is another object of the invention to provide a means for retarding the fall of the articles into the container which is readily adjustable and adaptable to compensate for different size articles and articles of different weight.

It is a still further object of the invention to provide an apparatus of the type described which is adaptable for use with articles such as bottles of different surface qualities and configurations.

Other objects and advantages will become apparent upon reference to the drawings and the detailed description of the drawings.

According to the invention, an apparatus for assembling articles such as bottles and loading them into a container is provided comprising a platform in the form of a grid and a conveyor for conveying the articles onto the platform. Means is provided for shifting the grid to permit the articles to fall therethrough. Apparatus is provided for retarding the fall of the articles as they pass through the grid and continue to fall, comprising an engaging or retarding plate mounted at the end of a retarder body which is pivotally mounted and connected to an end of a lever arm, and an adjustable weight at the other end of the lever arm. The position of the weight may be so adjusted that the engaging plate is urged against the side walls of the falling articles with a sufficient amount of force to retard or control the rate of fall of the articles to a safe value.

DESCRIPTION OF THE PREFERRED EMBODIMENTS

Figure 1:
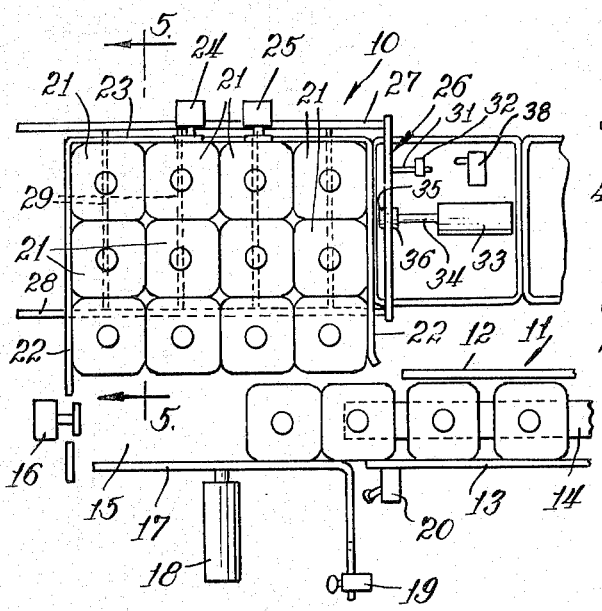
FIG. 1 is a top view of an apparatus according to the invention designed for conveying and loading 1-gallon size bottles.

Referring to FIG. 1, a caser apparatus 10 according to the invention is shown comprising a conveyor 11 having guides 12 and 13 and an endless conveyor belt 14. The apparatus further comprises a platform 15 on which rows of bottles 21 are loaded. Mounted on the platform 15 is a switch 16. An L-shaped pusher bar 17 is affixed to the piston of a hydraulic cylinder 18 and is provided with an adjustable switch actuator 19 adjustably mounted on a leg of the bar 17, and having a thumbscrew for affixing the actuator 19 in any desired position. A switch 20 is mounted on the guide 13 and arranged to be operated by the actuator 19. The bottles 21 may be formed of glass, plastic, or any other suitable material.

The loading portion of the apparatus comprises a frame formed by frame members 22 and 23. A pair of limit switches 24 and 25 are mounted on the frame. The apparatus further includes a grid assembly 26 for supporting the bottles and subsequently releasing them. As shown in greater detail in FIG. 3, the grid assembly comprises a pair of longitudinal rods 27 and 28 and a plurality of transverse bars 29 having the rods 27 and 28 disposed in apertures of the bars and affixed thereto by means such as welding. The grid assembly has a recess 30 provided in the leading transverse bar for attachment to the hydraulic cylinder which operates the assembly. A switch-actuating rod 31 is affixed to the bar and has a switch-engaging bar 32 adjustably mounted thereon. As seen in FIG. 1, a hydraulic cylinder 33 mounted on the frame has a shaft 34 affixed to the terminal bar 29 at the recess 30 by means of a bolt 35 and washer 36. Alternatively, a grooved collar could be used. The relationship of the lateral rods 27 and 28 is such that a pair of bottles 21 can fall therebetween. The spacing between the transverse bars 29 is such that a single bottle can fall therebetween. It can therefore be seen that the transverse bars 29 and lateral rods 27 and 28 cooperate to define a grid having interstices each of which can allow a pair of bottles to fall therethrough.

Figure 2:
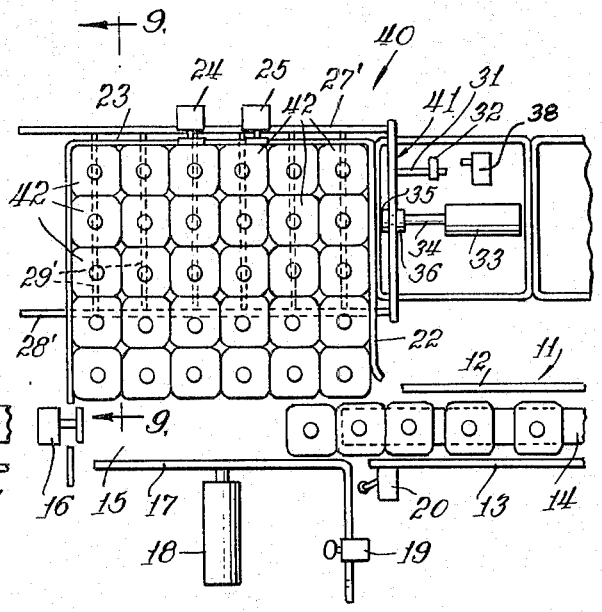
FIG. 2 is a top view of an apparatus according to the invention similar to that shown in FIG. 1, but designed for assembling and loading ½-gallon bottles.
Figure 3:
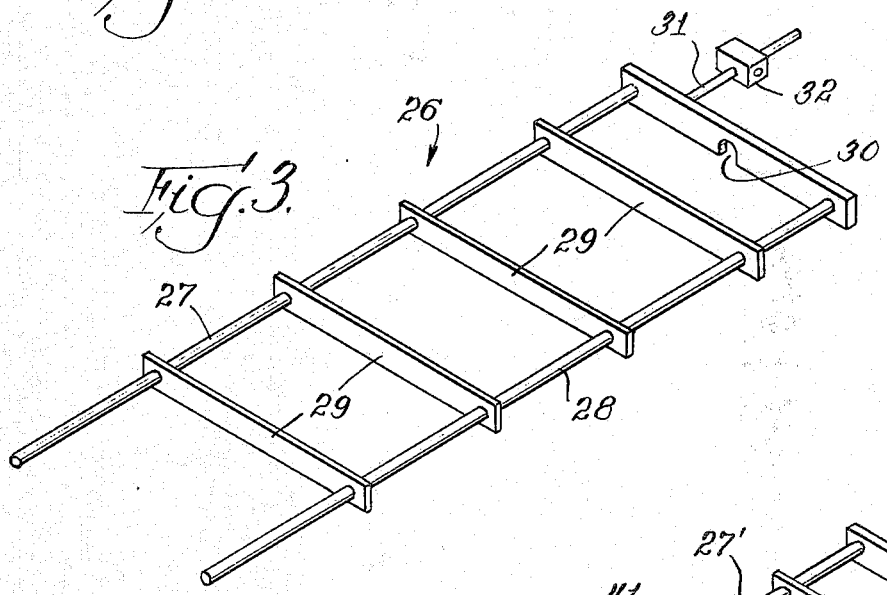
FIG. 3 is a perspective view of a grid assembly utilized in the apparatus of FIG. 1.
Figure 4:
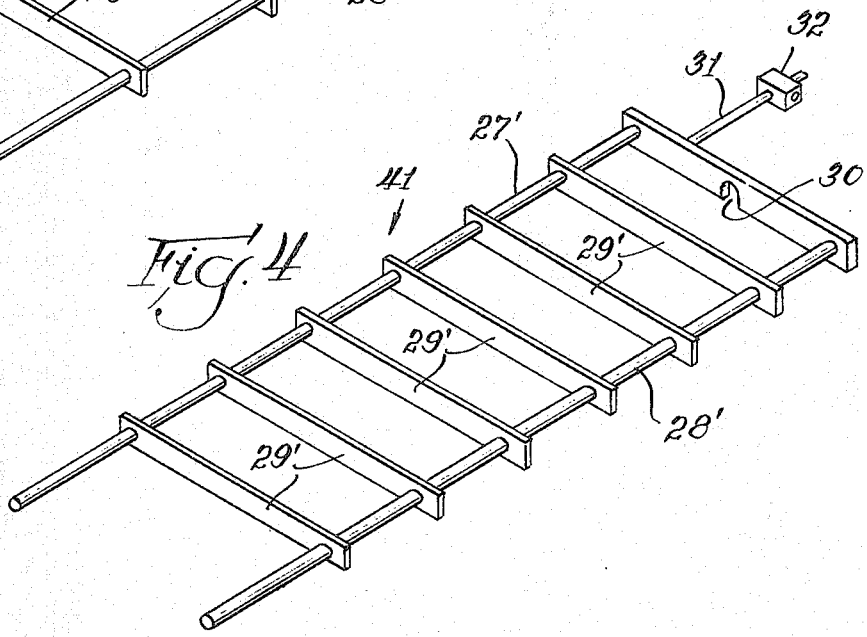
FIG. 4 is a perspective view of a grid assembly utilized in the apparatus of FIG. 2.

Referring to FIGS. 2 and 4, an apparatus 40 is shown which is similar to that shown in FIGS. 1 and 3, but adjusted for handling ½-gallon bottles. The major difference lies in the grid assembly 41 wherein the longitudinal rods 27′ and 28′ are spaced apart to accommodate three ½-gallon bottles, whereas the transverse bars 19′ are spaced apart only sufficiently to permit a ½-gallon bottle 42 to pass therebetween. Consequently, the longitudinal rods 27′ and 28′ cooperate with the transverse bars 19′ to define a grid having interstices each of which permit three ½-gallon bottles 42 to pass therethrough.

Figure 5:
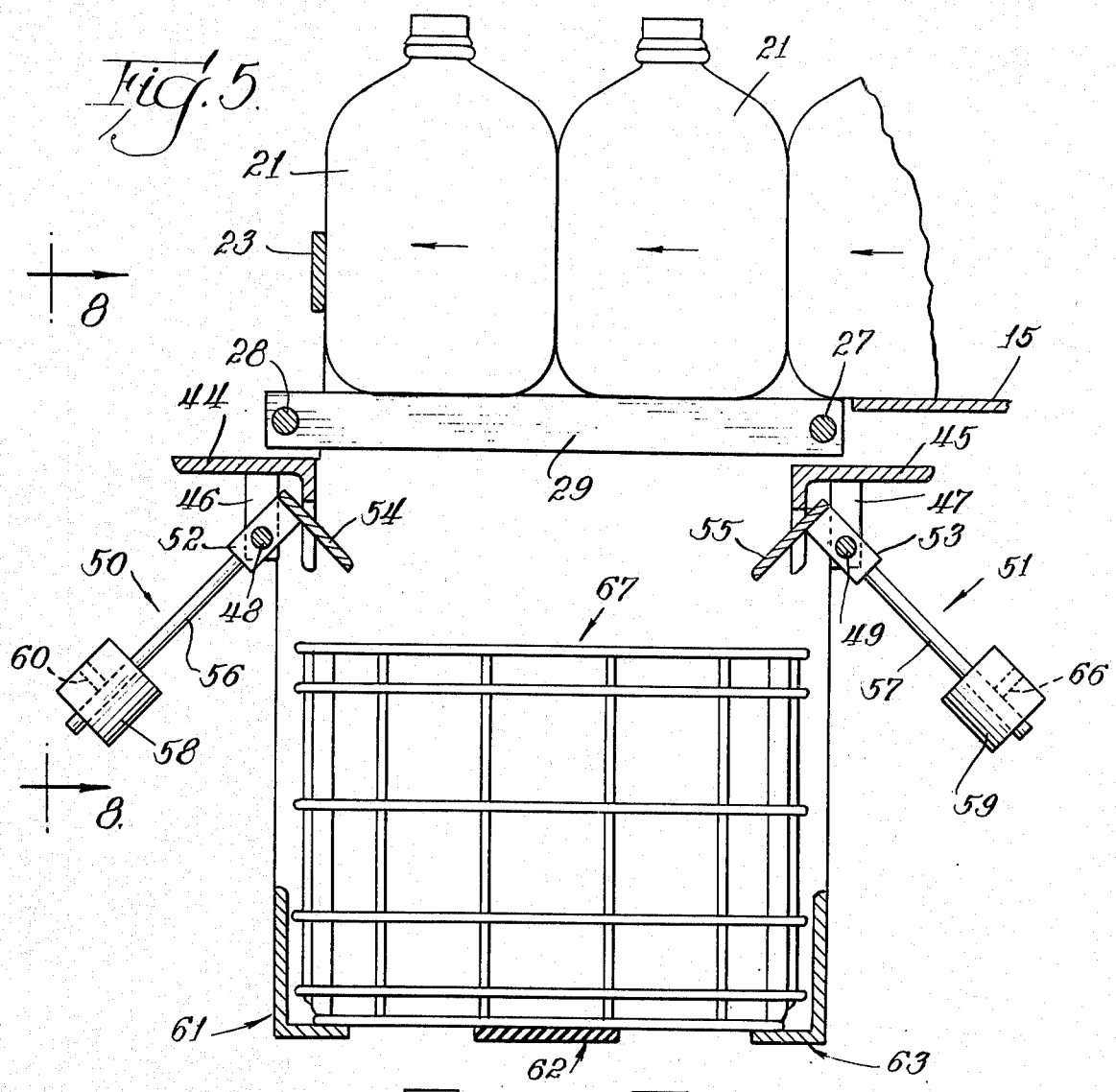
FIG. 5 is a fragmentary view partly in cross-section taken at the line 5—5 of FIG. 1, looking in the direction of the arrows.

Referring to FIGS. 5–8, the apparatus for dropping the bottles 21 and limiting their rate of fall to prevent breakage is shown and comprises a pair of angle iron frame members 44 and 45 having pairs of bearing members 46 and 47 mounted thereon and depending therefrom. Hinge pins or trunnions 48 and 49 are provided in the bearing members. On the hinge pins 48 and 49 are pivotally mounted retarders 50 and 51. The retarders 50 and 51 comprise body members 52 and 53, retarder plates 54 and 55, and lever arms or elongate members 56 and 57, respectively. Adjustable weights 58 and 59 are mounted on the lever arms 56 and 57, respectively, and maintained in the desired positions by set screws 60 and 66. Basket guide members 61, 62 and 63 are mounted on the apparatus and support a basket 67. The upper edges of the retarder plates 54 and 55 engage the bearing members 46 and 47, respectively, in their rest position or limiting position as shown in FIG. 5.

The operation of the apparatus according to the invention can be readily understood by referring to FIGS. 1, 3, and 5–8. As seen in FIGS. 1 and 3, bottles 21 travel on the belt 14 of the conveyor 11 and are guided by guide rails 12 and 13 to the platform 15. As each bottle reaches the platform, it is removed from the influence of the conveyor belt 14 and remains stationary on the platform until pushed by a succeeding bottle which reaches the platform. Ultimately four bottles reach the platform, at which point the first bottle actuates the switch 16. This causes the L-shaped pusher bar 17 to be operated upon by the hydraulic cylinder 18, thereby moving the four bottles laterally until the adjustable switch actuator 19 engages the switch 20, causing the push bar 17 to be retracted and permitting an additional four bottles to mount the platform. Each time the group of four bottles upon actuating the switch 16 are pushed laterally a distance sufficient to permit a new-arriving group of four bottles to proceed along the vacated space. As the bottles leave the platform 15 they are supported by the bars 29 of the grid assembly 26.

When a group of eight bottles is positioned over the grid 26, the foremost row of bottles trips the switches 24 and 25, causing the cylinder 33 to retract the rod 34, thereby retracting the grid 26 to the release position. This permits the group or charge of eight bottles to drop through the interstices of the grid 26 and to proceed toward the container below. With the grid 26 in this position, the actuator bar 32 trips the switch 38 and actuates the cylinder 33, causing the grid 26 to be returned to the normal rest position in which position it is ready to receive and support a new charge of bottles. In this position, the plates 54 and 55 extend into the space below the bottles, and the upper edges of the plates engage the bearing members 46 and 47, respectively, to provide a limiting or rest position for the retarder apparatus.

Figure 6:
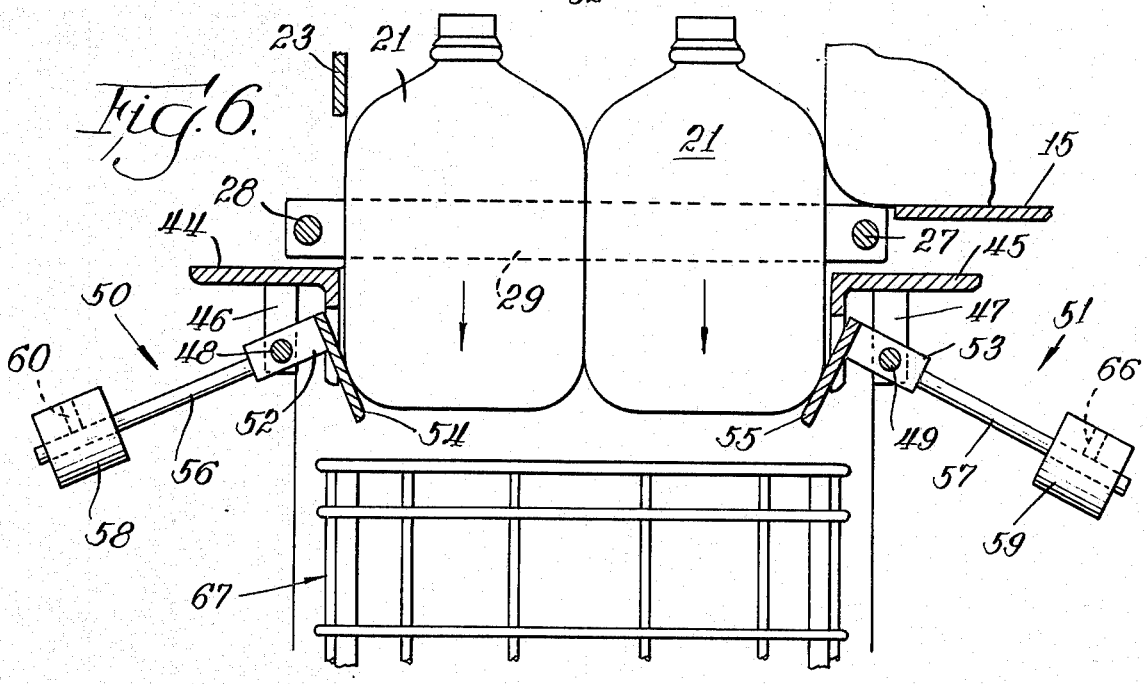
FIG. 6 is a view similar to that of FIG. 5 but showing the bottles in a more advanced view.
Figure 7:
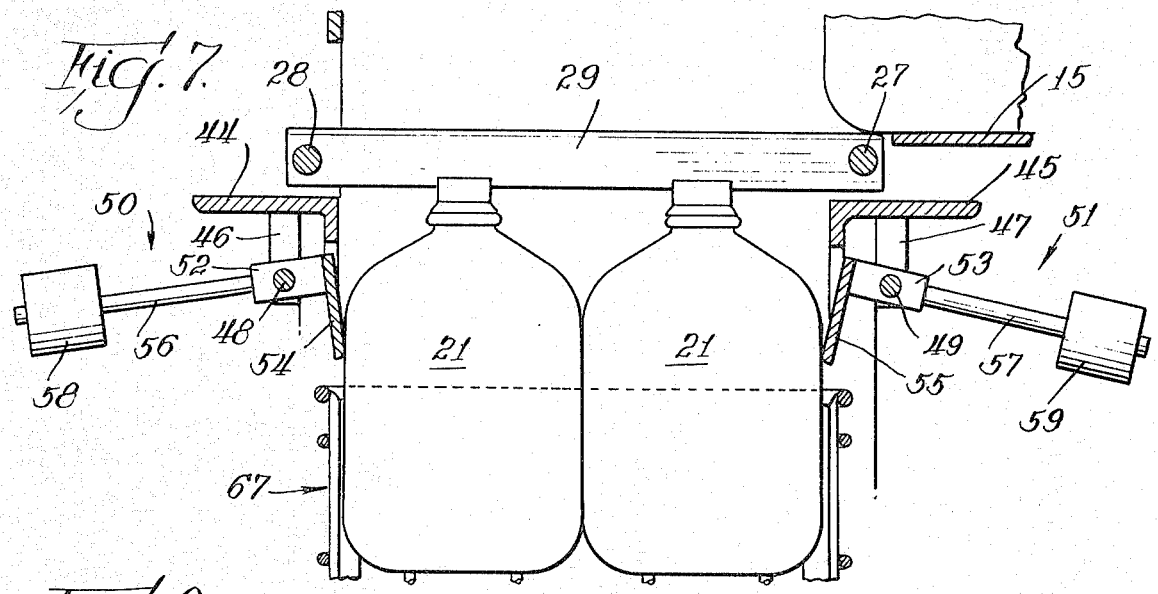
FIG. 7 is a view similar to that of FIG. 6 but showing the bottles in a still further advanced position.
Figure 8:
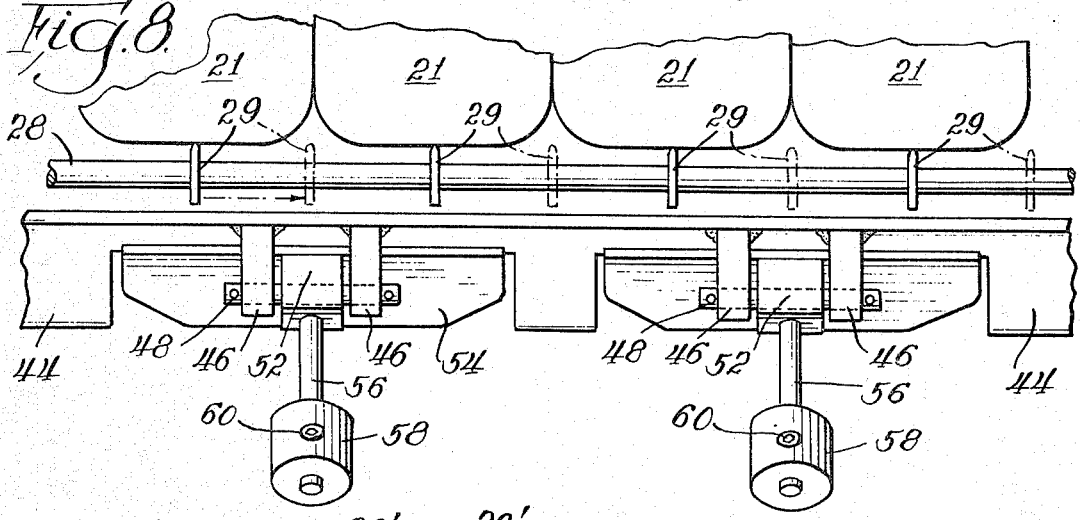
FIG. 8 is a fragmentary view taken at the line 8—8 of FIG. 5, looking in the direction of the arrows.

In FIG. 5, the apparatus is shown in the condition in which the grid 26 is in the rest or supportive position with a charge of bottles in place. In FIG. 6, the apparatus is in the condition just after the grid 26 has been moved to the release position and the bottles have encountered the retarder plates 54 and 55. Upon encountering the plates, the bottles slow down their downward descent and move the plates sufficiently so that the bottles can pass between the plates. This causes the weights 58 and 59 to rise to the normal retarding position shown in FIG. 7. The bottles continue to fall slowly, being retarded by the friction exerted by the retarder plates 54 and 55 rubbing against their sides with force applied by the weights 58 and 59. The bottles continue their retarded and controlled downward descent until they reach and enter the container 67.

Figure 9:
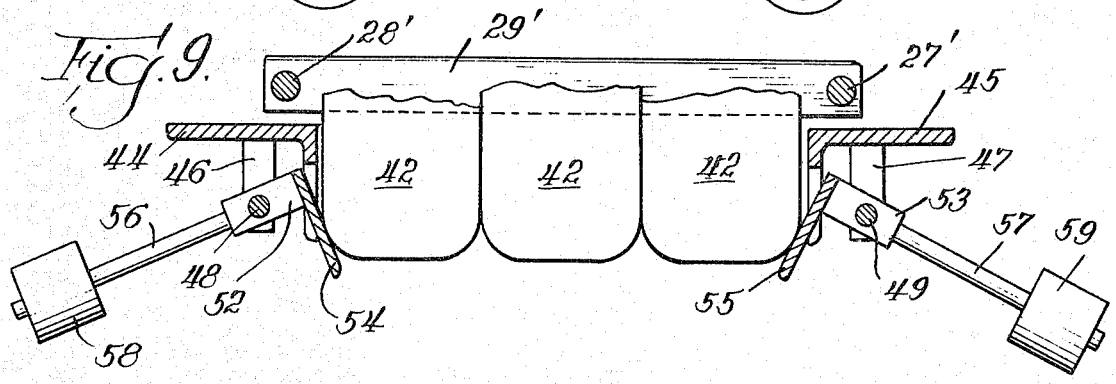
FIG. 9 is a fragmentary elevational view similar to that of FIG. 6, but showing the apparatus as utilized for assembling and loading ½-gallon bottles.

FIGS. 2, 4 and 9 illustrate the apparatus of the invention as utilized for loading ½-gallon bottles. The apparatus is basically the same as that shown in FIGS. 1, 3, and 5–8, except that the grid 41 as shown in FIG. 4 is utilized. In the rest and loading position the bottles are supported by the bars 29′ mounted on rods 27′, with each bar 29′ being positioned substantially medially of the bottles it supports. The lateral guide 22 may be adjusted if necessary to the dimensions necessary to restrain a plurality, as for example six bottles arranged in a row. The bars 29′ are spaced to permit a ½-gallon bottle to fall through the interstices when the grid is moved to the release position. In assembling a charge of bottles and subsequently releasing the bottles with controlled falling motion into the container the apparatus works substantially the same as described with regard to 1-gallon size bottles. Because of the force applied by the retarder plates, a clamping action by the outer rows of bottles is applied to the middle row, with the result that the middle row descends together with the outer rows and is restrained by the clamping force provided by the outer rows and the frictional engagement of the surfaces of the bottles of the middle row with the surfaces of the bottles of the outer rows.

Figure 10:
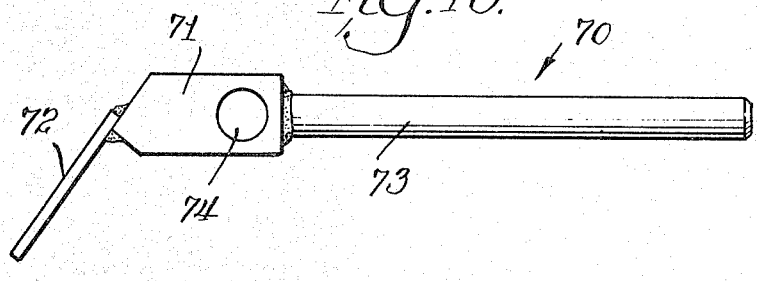
FIG. 10 is an elevational view of a retarder member in another embodiment of the invention.

Referring to FIG. 10, a modified embodiment of a retarder member 70 according to the invention is shown comprising a body member 71 having a retarder plate 72 welded thereto and a lever arm or rod 73 affixed to the other end of the body member 71. An aperture 74 is provided for pivoting the retarder member. As can be seen in the drawing, the retarder plate 72 is disposed at an angle of about 140° with respect to the arm 73, whereas the lever arms 54 and 55 shown in FIGS. 5–9 are disposed at an angle of about 90° with respect to the lever arms 56 and 57. Moreover, in the embodiment of FIG. 10, the plate 72 is affixed at a lower portion of the body member 71 than are the plates 54 and 55 affixed with respect to the body members 52 and 53. The embodiment of FIG. 10 is arranged so that in the rest position the retarder plates 72 are disposed substantially horizontally with respect to the apparatus; consequently, because the plates 72 and arms 73 are disposed at an obtuse angle or angle greater than 180°, the arms 73 when carrying a weight provide a moment of force to urge the plates 72 against the bottles when they descend. Although the embodiments of FIG. 5–9 are preferred, the embodiment of FIG. 10 is useful for certain applications. The embodiment of FIG. 10 for some applications has the advantage that since the arm 73 is raised to a greater angle when the plate 72 engages the bottles, a reduced and more gentle force is applied to retard the bottles.

Figure 11:
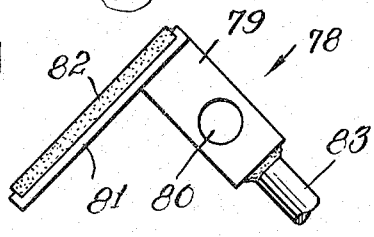
FIG. 11 is a fragmentary elevational view of a retarder member illustrating still another embodiment.

Referring to FIG. 11, another modification of the retarder member 78 is shown comprising a body member 79 having a plate 81 affixed thereto having a sheet or pad 82 of a resilient and friction-providing material affixed thereto. A lever arm or rod 83 is affixed to the other end of the body member 79, and an aperture 80 is provided for pivotally mounting the retarder member. When the pad 82 is engaged by a falling bottle, it provides a resilient or cushioning effect to minimize the chance of breaking the bottles, and additionally to provide enhanced frictional engagement to further retard the descending movement of the bottles.

The apparatus of the present invention has several advantages over apparatuses of the prior art designed for similar purposes. First, the apparatus is highly adaptable to handle bottles or other articles of various sizes, shapes, and weights. The retarder plates gently engage the falling bottles and provide a gentle but uniform force against the outer surfaces of the outer bottles which not only retard the outer bottles but also cause the outer bottles to press against the sides of the inner bottles and to carry them along into the container. If desired, the plates may be covered with various resilient and friction-providing materials to enhance the retarding action and provide greater protection against breakage. The present apparatus is reliable, is relatively simple and inexpensive to produce, and operates over long periods of time with little or no maintenance.

It is to be understood that the invention is not to be limited to the exact details of operation or structures shown and described, as obvious modifications and equivalents will be apparent to one skilled in the art.

I claim:

1. An apparatus for assembling a charge of a plurality of articles of similar size and shape and dropping said articles into a container at a controlled velocity, comprising:

frame means, means for assembling a charge of said articles at a container-filling station, article support means for supporting said articles until a full charge has been assembled, container support means for supporting at said container-filling station a container adapted to receive said charge, and release means for releasing said charge of articles to permit it to fall into a container positioned therebelow on said support means; and means entirely independent of said container for controlling the rate of fall of said articles thereinto to prevent damage thereto, comprising:

at least one retarder member comprising a supporting body pivotally mounted on said frame, an elongate member mounted on said supporting body supporting a weight mounted thereon, and means on said supporting body defining a retarding surface positioned to interrupt the fall of said charge by engaging an outwardly-positioned bottom edge of said charge, said weight being insufficient to completely counterbalance the weight of said charge and said retarding surface and the pivot of said supporting body being so located relative to each other and to said charge that further downward movement of said charge causes said retarding surface to rotate about said pivot until said charge can slip past said retarding surface, said weight then causing said retarding surface to bear on a lateral side of said charge with sufficient force to retard to a safe value the rate of descent of said charge as it drops into the said container, said container support being located sufficiently below said retarding surface that when the charge is seated in said container, the top of said charge is below said retarding surfaces and said container never comes in contact with said retarding surfaces.

2. An apparatus according to claim 1, having a plurality of retarder members mounted at least one on each of opposite sides of said charge of articles so arranged that each article of said charge is engaged by a retarding surface.

3. An apparatus according to claim 1, having a plurality of retarder members mounted at least two on each of opposite sides of said charge of articles so arranged that each article of said charge is engaged by a retarding surface.

4. An apparatus according to claim 2, wherein each elongate member is linear, has the retarder means attached to one end and the weight to the other end and is pivoted at a point intermediate said ends and adjacent to but spaced from said retarder means.

5. An apparatus according to claim 4, wherein the weights on the elongate members are adjustable toward and away from the pivot point.

6. An apparatus according to claim 4, wherein said retarder surfaces are flat plates having their upper edges affixed to the end of the elongate members at an angle therewith.

7. Apparatus of claim 1 wherein said support and release mechanism is supported on a frame and comprises a grid movably mounted on said frame having interstices each sufficiently large to permit an article to fall therethrough, and arranged to move from a rest position in which said articles are supported to another position in which said articles are permitted to fall through the interstices of said grid, and wherein the frame has an aperture beneath said grid which is the size and shape of the full charge and aligned therewith, so that when the grid is moved to release position, the charge can fall freely into a container disposed beneath said aperture and in alignment therewith.

8. An apparatus according to claim 6, wherein the angle subtended by said flat plates and said elongate members is about 90°.

9. An apparatus according to claim 6, wherein the angle subtended by said flat plates and said elongate members is about 140°.

10. An apparatus according to claim 4, wherein said support body members are pivotally mounted in bearing members affixed to said frame and depending therefrom.

11. An apparatus according to claim 10, wherein said bearing members engage the top edges of said plates to provide limits for their rest positions.

12. An apparatus according to claim 6, wherein a sheet of a resilient friction-providing material is affixed to each of said plates.

13. An apparatus according to claim 7, wherein the grid is removable and replaceable by another grid having interstices of different dimensions to accomodate articles of comparable dimensions which, when assembled, give a charge of essentially the same dimensions as the aperture.

14. Apparatus of claim 1, the combination therewith of power means for moving said support and release mechanism from support position to release position and switch means for actuating said power means to release position so located that the switch means is activated by contact with the first row of articles when the full charge is assembled.

* * * * *

UNITED STATES PATENT OFFICE

CERTIFICATE OF CORRECTION

Patent No. 4,003,185 Dated January 18, 1977

Inventor(s) Otis Ward Goff

It is certified that error appears in the above-identified patent and that said Letters Patent are hereby corrected as shown below:

Col. 7, line 3:

should read: --- Apparatus of Claim 1, <u>including</u> the combination ---.

Signed and Sealed this

*fifth* Day of *July 1977*

[SEAL]

*Attest:*

RUTH C. MASON
*Attesting Officer*

C. MARSHALL DANN
*Commissioner of Patents and Trademarks*